US007575436B1

(12) United States Patent
Devlin et al.

(10) Patent No.: US 7,575,436 B1
(45) Date of Patent: Aug. 18, 2009

(54) ROTATING PLUG ADAPTER WITH INTEGRAL TWO BLADE RECEPTACLE

(75) Inventors: Thomas E. Devlin, Somerville, MA (US); George Favaloro, Lincoln, MA (US)

(73) Assignee: Southwire Company, Carrollton, GA (US)

( * ) Notice: Subject to any disclaimer, the term of this patent is extended or adjusted under 35 U.S.C. 154(b) by 0 days.

(21) Appl. No.: 12/026,916

(22) Filed: Feb. 6, 2008

(51) Int. Cl.
*H01R 39/00* (2006.01)

(52) U.S. Cl. ..... 439/21

(58) Field of Classification Search ..... 439/21, 439/22, 11, 13, 346
See application file for complete search history.

(56) References Cited

U.S. PATENT DOCUMENTS 4,626,052 A * 12/1986 Rumble ..... 439/173
4,703,988 A * 11/1987 Raux et al. ..... 439/321
4,856,999 A * 8/1989 Flohr ..... 439/52
5,269,697 A * 12/1993 Essex ..... 439/148
5,399,093 A * 3/1995 Schneider et al. ..... 439/21
5,551,882 A * 9/1996 Whiteman et al. ..... 439/21
5,658,152 A * 8/1997 Selker ..... 439/31
5,775,921 A 7/1998 Chou
5,954,519 A 9/1999 Hsiao
5,997,310 A 12/1999 Chiu et al.
6,089,921 A 7/2000 Chou
6,302,743 B1 10/2001 Chiu et al.
6,332,794 B1 12/2001 Jeng
6,457,988 B1 10/2002 Andersen
6,793,499 B1 9/2004 Chen

* cited by examiner

*Primary Examiner*—Alexander Gilman
(74) *Attorney, Agent, or Firm*—Smith, Gambrell & Russell

(57) ABSTRACT

A rotating two blade plug adapter includes a housing including a top and bottom coupled to freely rotate about a rotary cap disposed between the housing top and bottom. Right and left electrical spades extend from the rotary cap and a receptacle integral to the periphery of the housing accepts a two blade plug that may be oriented at a wall receptacle by rotating the adapter housing and receptacle to a desired orientation. Internal flanges define grooves in which rotary electrical contacts are maintained through rotation of the housing and integral receptacle.

12 Claims, 4 Drawing Sheets

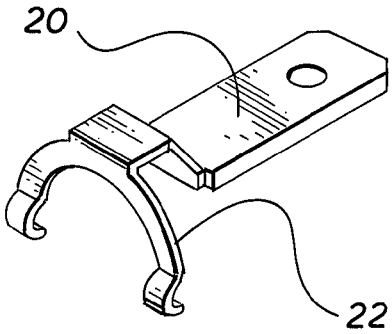
Fig. 6
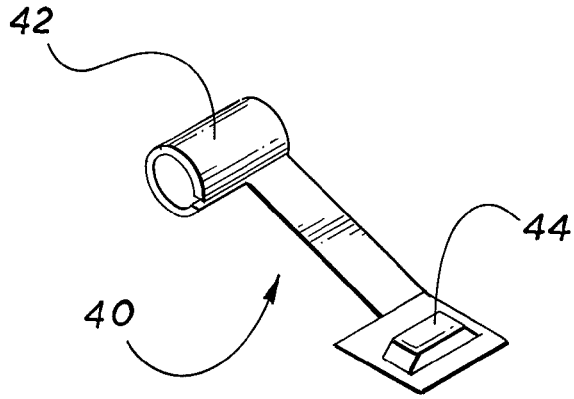
Fig. 7
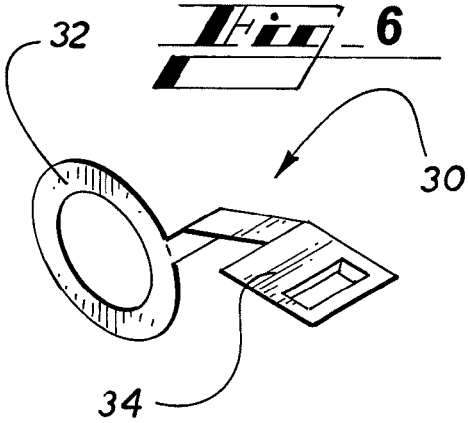
Fig. 8
Fig. 9
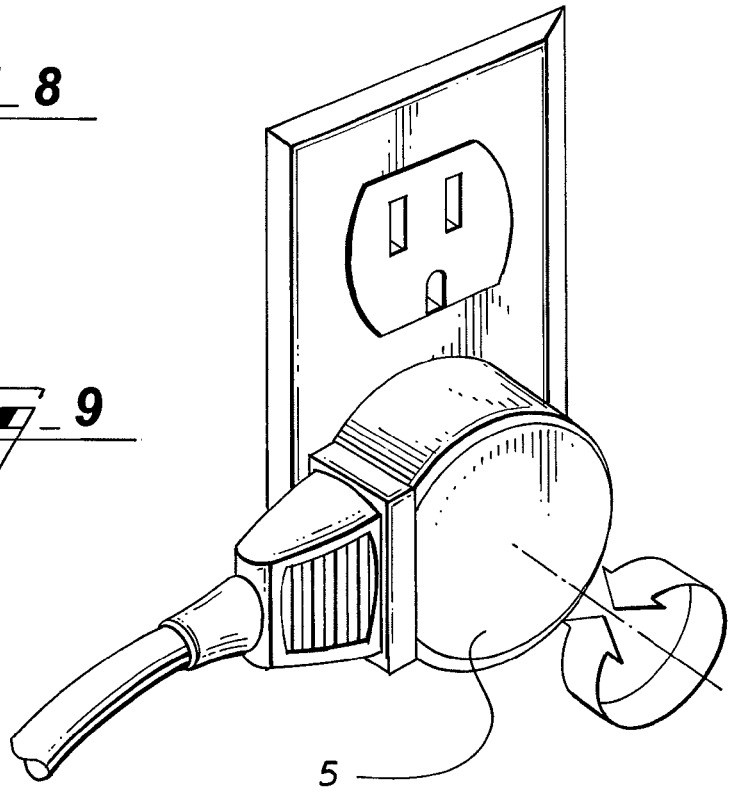

ROTATING PLUG ADAPTER WITH INTEGRAL TWO BLADE RECEPTACLE

BACKGROUND

The present invention relates to two blade electrical plugs and adapters, and more particularly to rotating plug adapters. Conventional plug adapters and plugs typically extend in a one-way outward direction perpendicular to a wall receptacle. As a result, conventional plugs often obstruct the positioning of furniture, appliances and other items close to wall.

U.S. Pat. No. 5,775,921 to Chou teaches flat profile rotating electrical plugs suitable for narrow areas. Such plugs, however, require direct wiring to an electrical apparatus or appliance, and are therefore incompatible for enabling rotation of an existing plug at a wall receptacle. Similarly, known extension cords and power strips with rotating plugs require direct wiring to the plug that is plugged into the receptacle.

A need therefore exists for a rotating plug adapter with an integral receptacle that does not require direct wiring to an electrical appliance. Further there is a need for a rotating adapter enabling conventional plugs to be rotatably oriented directly at a wall receptacle without an additional extension cord or power strip wired to a plug.

SUMMARY OF THE INVENTION

The present invention answers these needs by providing in one embodiment an electrical plug adapter comprising a housing including a top, bottom and outer periphery, a cap rotatably mounted between the top and bottom of the housing, a first spade mounted in the cap, wherein the first spade includes a first spade rotary contact rotatably abutting a first housing rotary contact, a second spade mounted in the cap, wherein the second spade includes a second spade rotary contact rotatably abutting a second housing rotary contact, a plug receptacle integral to the outer periphery of the housing and rotatable around the rotary cap, wherein the plug receptacle includes a first receptacle opening including a portion of the first housing rotary contact mounted therein, and a second receptacle opening including a portion of the second housing rotary contact mounted therein.

In one embodiment a rotary ratchet spring mounted between the top and bottom of the housing is provided to facilitate firm orientation of the integral plug receptacle once rotated to a desired position. In further embodiments, the rotary cap include a plurality of teeth and the ratchet spring includes one or more wings rotatable between a pair of teeth to lock the ratchet and housing with the plug receptacle facing a desired position.

In other embodiments of the invention the housing of a rotatable plug adapter is flat and low profile. In such embodiments it is an object of the invention to allow existing conventional plugs to be oriented at a desired rotatable position in the adapter while improving the fit over perpendicular insertion of conventional plugs into conventional wall receptacles that obstruct furniture, appliances and other items that may be placed close to the wall receptacle.

BRIEF DESCRIPTION OF THE DRAWINGS

FIG. 6 is an elevational view of right spade and right spade rotary contact in an embodiment of the present invention.

FIG. 7 is an elevational view a left spade housing rotary contact in an embodiment of the present invention.

FIG. 8 is an elevational view a right spade housing rotary contact in an embodiment of the present invention.

FIG. 9 is a perspective view of a rotating plug adapter engaged in a receptacle in an embodiment of the present invention.

DETAILED DESCRIPTION OF THE INVENTION

Figure 1:
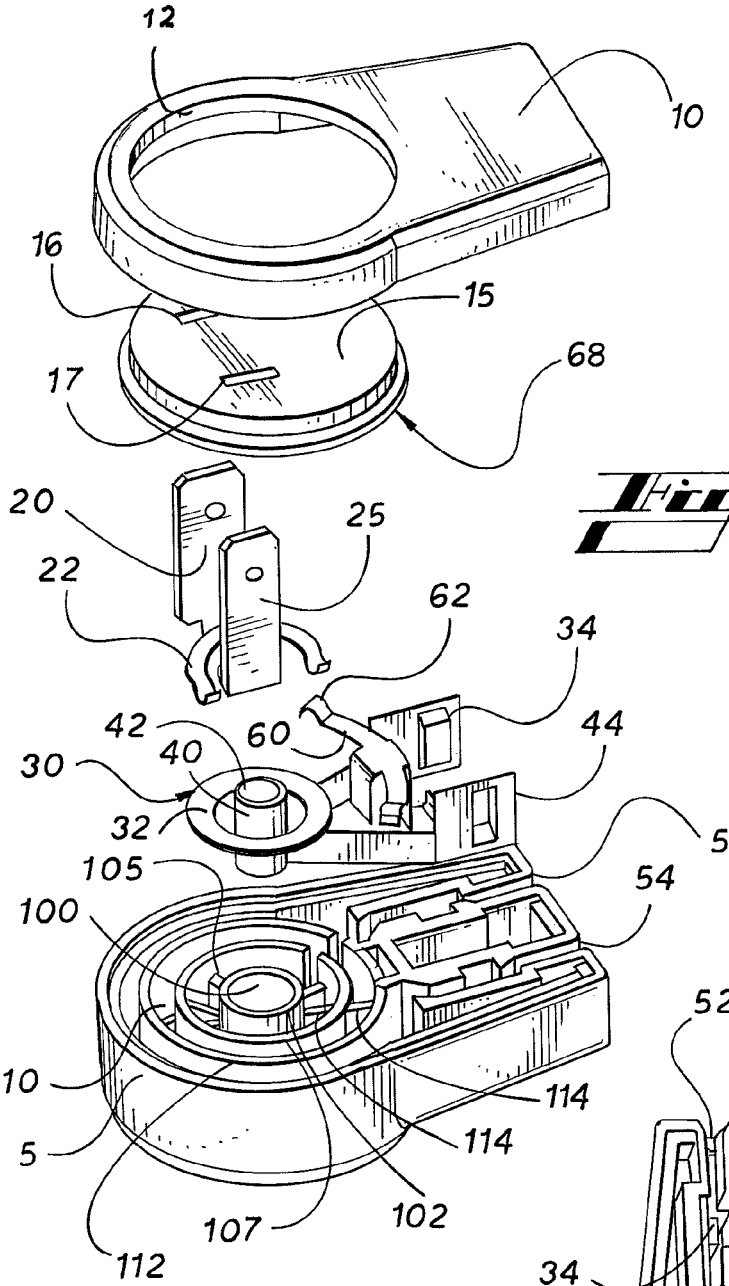
FIG. 1 is an exploded view of a plug adapter in an embodiment of the present invention.

Embodiments of the invention will be described with reference to the accompanying drawings and figures wherein like numbers represent like elements throughout. Directional terms, such as left and right depend on one's point of view, and are intended to be non-limiting as such described components are reversible in alternative embodiments. Further, it is to be understood that the phraseology and terminology used herein is for the purpose of description and should not be regarded as limiting. The use of "including", "comprising", or "having" and variations thereof herein is meant to encompass the items listed thereafter and equivalents thereof as well as additional items. The terms "mounted", "connected", and "coupled" are used broadly and encompass both direct and indirect mounting, connecting and coupling. Further, "connected" and "coupled" are not restricted to physical or mechanical connections or couplings.

In one described embodiment, the invention provides a flat profile rotating plug adapter. It will be appreciated that other embodiments of the invention include rotating plug adapters with alternative sizes, shapes and profiles.

In one embodiment the invention provides electrical contacts that includes metal conductors with sufficient cross section to carry a rated load of 20 amps. In other embodiments the invention and corresponding structures may be scaled to carry greater loads.

Referring to FIGS. 1-4, a rotating plug adapter in an embodiment of the invention generally includes a housing with a top 5 and bottom 10, a rotatable receptacle 50 integral to an outer periphery of the housing, a rotary cap 15 and right spade 20 and left spade 25 mounted in the cap. Rotatable contact elements and grooves within the housing provide rotatable electrical connections between the receptacle 50 and plug portion of the adapter that includes spades 20 and 25.

The housing comprises a coupled top 5 and bottom 10 of insulative material. Rotary cap 15, also of insulative material, is mounted in a cap opening 12 between housing top 5 and housing bottom 10. The cap 15 is mounted to freely rotate within the cap opening 12 and the surrounding housing of the adapter plug.

In one embodiment shown in FIG. 1, the cap includes left spade slot 16 and right spade slot 17. In an alternative embodiment, spades 20 and 25 are mounted in slots 16 and 17. In other embodiments spades 20 and 25 may be integrally mounted in Cap 15, such as insert molded directly in the cap 15.

Figure 5:
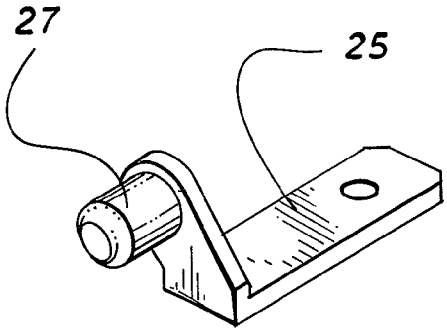
FIG. 5 is an elevational view of a left spade and left spade rotary contact in an embodiment of the present invention.

With further reference to FIGS. 5 and 6, right spade 20 includes a rotary contact 22. In the described embodiment, rotary contact 22 is an annular segment contact portion with brushes integrally connected to the spade 20. Left spade 25 is mounted in left opening 17. Left spade 25 includes a rotary contact 27. In the described embodiment, rotary contact 27 is a post portion integrally connected to the spade 20.

Figure 2:
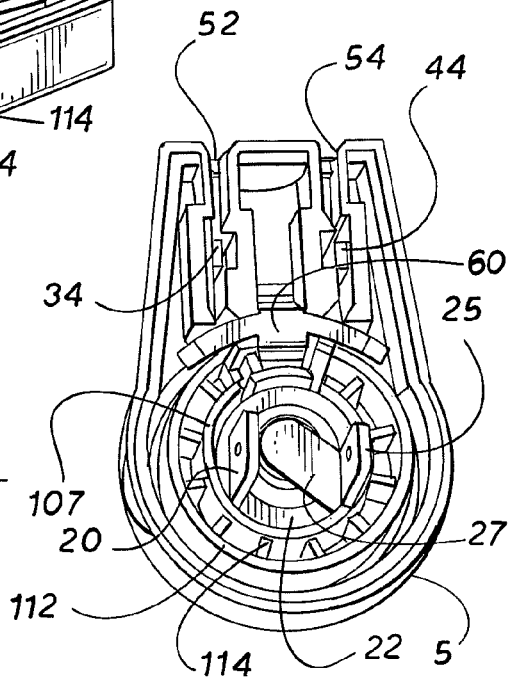
FIG. 2 is an internal perspective assembly view of a housing top in an embodiment of the present invention.
Figure 4:
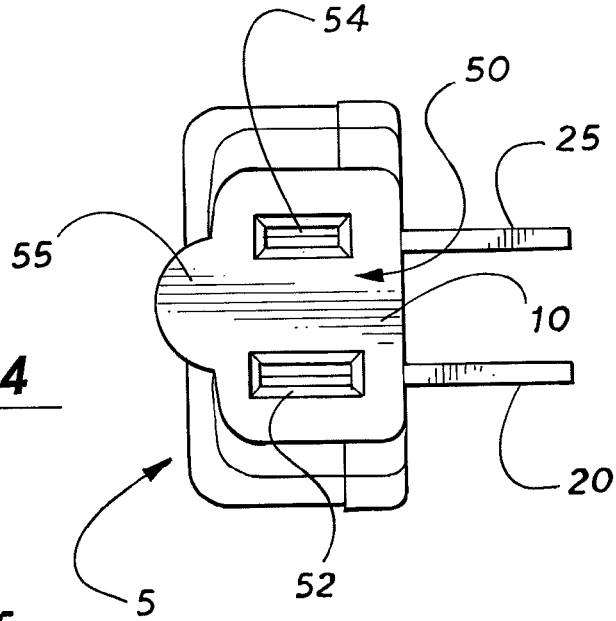
FIG. 4 is a top plan view of plug adapter housing and integral receptacle in an embodiment of the present invention.

Referring to FIGS. 1, 2 and 4, housing top 5 includes a central annular flange 102 defining a central groove 100. A first concentric annular flange 107 defines a first concentric annular groove 105 between itself and flange 102. A second concentric annular flange 112 defines a second concentric annular groove 110 between itself and flange 107. Housing support gussets 114 are provided within annular groove 110 to reinforce the concentric flanges and maintain desired positioning of electrical contact elements.

An integral receptacle 50 includes left blade opening 54 and right blade opening 52 which include respective grooves extending into the housing top 5. It will be appreciated that the flanges and grooves are constructed to ensure proper electrical contacts and to avoid unwanted electrical contacts. It will also be appreciated that depicted grooves and flanges are exemplary, and flanges may define other groove shapes that permit rotary motion of the plug adapter while maintaining proper electrical contacts between a plug in receptacle 50 and spades 20 and 25 engaged in a wall receptacle.

With continuing reference to FIGS. 1, 2 and 4, and further reference to FIG. 7, a left spade housing rotary contact 40 includes sleeve contact portion 42 and left plug blade contact portion 44. Left blade housing rotary contact 40 is mounted with sleeve contact portion 42 in central groove 100 and left plug blade contact portion 44 extending through slots in flanges 102, 107 and 112 into the groove of left blade opening 54. Annular contact portion 42 rotatably abuts the post portion of rotary contact 27 of left spade 25 within sleeve contact portion 42.

With continuing reference to FIGS. 1, 2 and 4, and further reference to FIG. 8, a right spade housing rotary contact 30 includes annular contact portion 32 and right plug blade contact portion 34. Right blade housing rotary contact 30 is mounted with annular contact portion 32 positioned in first concentric annular groove 105 and right plug blade contact portion 34 extending through slots in flanges 107 and 112 into the groove of right blade opening 52. Annular contact portion 32 slidingly abuts the annular segment portion of rotary contact 22 of right spade 20.

With continuing reference to FIGS. 1 and 2, in embodiments of the invention a rotary ratchet spring 60 is mounted to avoid electrical contact with any contact portions between the top 5 and bottom 10 of the housing. Rotary ratchet spring 60 includes one or more ratchet wings 62 that engage ratchet teeth 65, such as a saw tooth pattern, provided around the perimeter of rotary cap 65. Spring loaded wings 62 engage teeth 65 as the housing is rotated about the rotary cap 15 with spades 20 and 25 in a wall receptacle. Rotary ratchet spring 60 enables the receptacle 50 to remain firmly oriented once the housing and receptacle 50 are rotated to a desired position.

Figure 3:
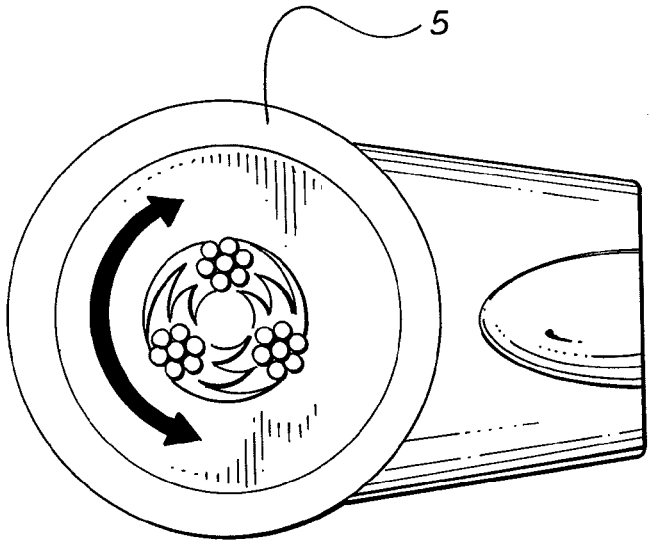
FIG. 3 is a top plan view of a plug adapter housing in an embodiment of the present invention.

Referring to FIGS. 3 and 4, in one embodiment of the invention, housing top 5 includes a grounding prong guard 55 to restrict receptacle 50 to receiving 2 blade plugs. Grounding prong guard 55 is a hump formed in housing top 5.

Referring to FIGS. 3, 4 and 9, embodiments of the invention are shown for a plug adapter in which an integral plug receptacle 50 on the periphery of the adapter housing is rotatable through a rotation of 360 degrees. Rotary cap 15 with spades 20 and 25 engaged in a wall receptacle remains in fixed position, as the housing formed of the coupling of housing top 5 and housing bottom 10 are free to rotate about the unfixed rotary cap 15 and spades 20 and 25. Receptacle 50 which engages a two blade plug, such as from an electric appliance, is rotated to a desired position.

Figure 10:
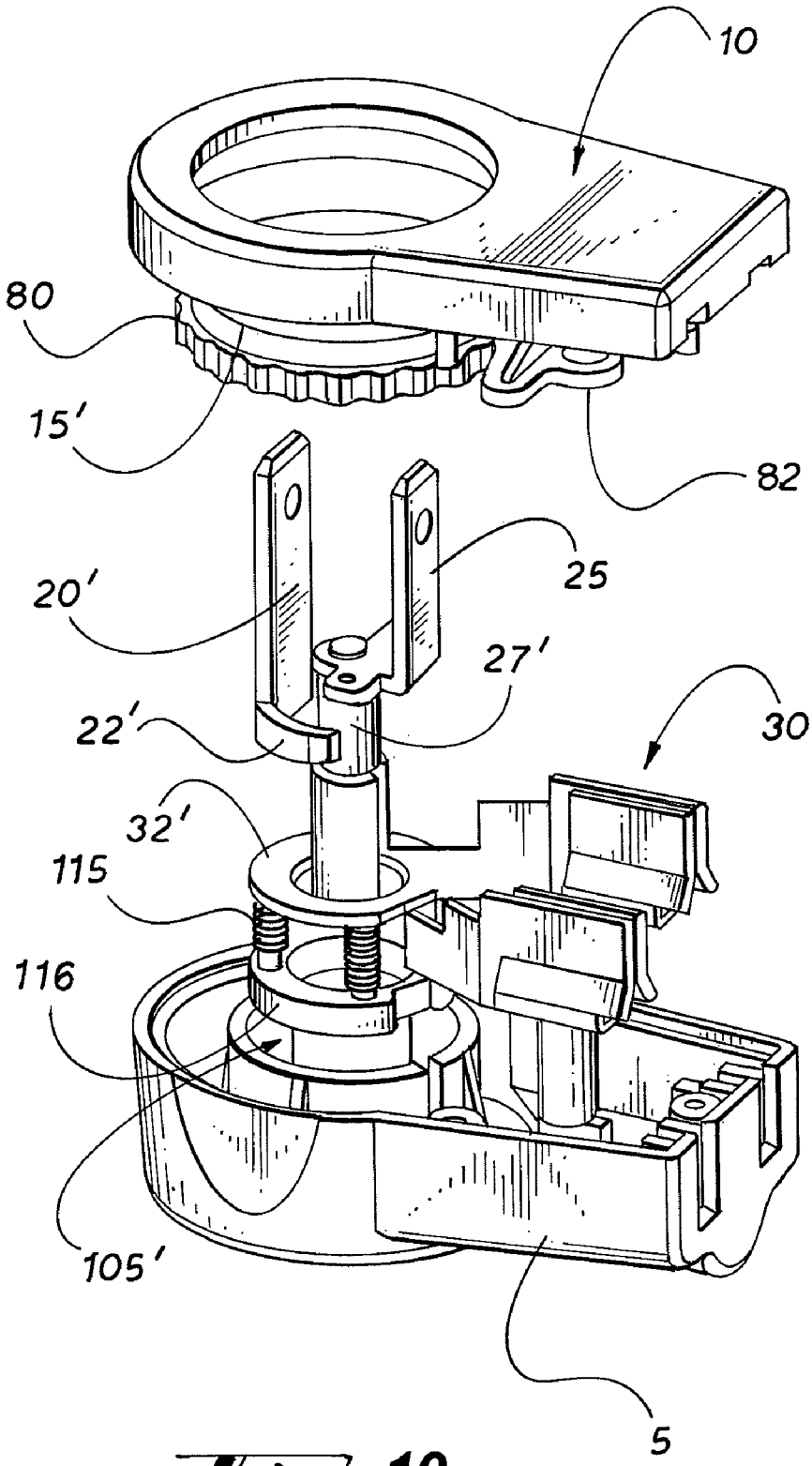
FIG. 10 is an exploded view of a second embodiment of the present invention.

Although the invention herein has been described with reference to particular embodiments, it is to be understood that these embodiments are merely illustrative of the principals and applications of the present invention. For example, in alternative embodiment the rotatable plug adapter could be provided in an arrangement with rigid brushes and contacts wherein springs are mounted between the housing top 5 and housing bottom 10, such as disclosed in U.S. Pat. No. 5,775,921. FIG. 10 is an exploded perspective view of an embodiment of such a rotatable plug adaptor showing springs 115 mounted on posts formed on an insulative ring 116 positioned within annular groove 105' with housing contact ring 32' of right spade housing rotary contact 30' supported thereon such that ring 32' is biased toward contact with the brushes of annular segment 22' of plug 20'. Cap 15' is formed with an annular toothed ring 80 about its periphery Pawl 82 is mounted to top 10 to selectively engage toothed ring to enables the receptacle 50' to remain firmly oriented once the housing and receptacle 50' are rotated to a desired position.

Accordingly, while the invention has been described with reference to the structures and functions disclosed, it is not confined to the details set forth, but is intended to cover such modifications or changes as may fall within the scope of the following claims.

What is claimed is:

1. An electrical plug adapter comprising:

a housing including a top, bottom and outer periphery with a rotary ratchet spring mounted between the top and bottom of the housing a cap rotatably mounted between the top and bottom of the housing wherein the rotatable cap includes a plurality of teeth and the ratchet spring includes one or more wings rotatable between a pair of teeth to lock the cap and housing in a selected relative position;

a first spade mounted in the cap, wherein the first spade includes a first spade rotary contact rotatably abutting a first housing rotary contact;

a second spade mounted in the cap, wherein the second spade includes a second spade rotary contact rotatably abutting a second housing rotary contact;

a plug receptacle integral to the outer periphery of the housing and rotatable around the rotary cap, wherein the plug receptacle includes a first receptacle opening including a portion of the first housing rotary contact mounted therein; and a second receptacle opening including a portion of the second housing rotary contact mounted therein further comprising:

a sleeve of the first spade rotary contact covering a post of a first housing rotary contact; and the second spade rotary contact and second housing rotary contact each include a slip ring.

2. The adapter of claim 1 further comprising a grounding prong guard at the receptacle on the outer periphery of the housing.

3. The adapter of claim 1 wherein the top of the housing is flat and low profile.

4. The adapter of claim 1 wherein the portion of the first housing rotary contact mounted in the first receptacle opening includes a flat contact for abutting a flat blade of a plug and the portion of the first housing rotary contact mounted in the first receptacle opening includes a flat contact for abutting a flat blade of a plug.

5. The adapter of claim 4 further comprising one or more springs mounted between the top and bottom of the housing to maintain contact between the second spade rotary contact and second housing rotary contact.

6. The adapter of claim 5 further comprising a grounding prong guard at the receptacle on the outer periphery of the housing.

7. The adapter of claim 4 further comprising further comprising a grounding prong guard at the receptacle on the outer periphery of the housing.

8. The adapter of claim 4 wherein the top of the housing is flat and low profile.

9. An electrical plug adapter comprising:

a housing including a top, bottom and outer periphery;

a cap rotatable mounted between the top and bottom of the housing;

a first spade mounted in the cap, wherein the first spade includes a first spade rotary contact rotatable abutting a first housing rotary contact;

a second spade mounted in the cap, wherein the second spade includes a second spade rotary contact rotatable abutting a second housing rotary contact;

a plug receptacle integral to the outer periphery of the housing and rotatable around the rotary cap, wherein the plug receptacle includes a first receptacle opening including a portion of the first housing rotary contact mounted therein; and a second receptacle opening including a portion of the second housing rotary contact mounted therein, further comprising:

a sleeve of the first housing rotary contact covering a post of a first spade rotary contact; and the second spade rotary contact and second housing rotary contact each include a slip ring.

10. The adapter of claim 9 wherein the portion of the first housing rotary contact mounted in the first receptacle opening includes a flat contact for abutting a flat blade of a plug and the portion of the second housing rotary contact mounted in the second receptacle opening includes a flat contact for abutting a flat blade of a plug.

11. The adapter of claim 10 further comprising one or more springs mounted between the top and bottom of the housing to maintain contact between the second spade rotary contact and second housing rotary contact.

12. An electrical plug adapter comprising:

a housing including a top, bottom and outer periphery; a cap rotatably mounted between the top and bottom of the housing;

at least a first spade mounted in the cap, wherein the first spade includes a first spade rotary contact abutting a first housing rotary contact, said first spade rotary contact and first housing rotary contact each include a slip ring at least one other electrically conductive prong mounted in the cap and extending therefrom, wherein said other electrically conductive prong includes a second rotary contact mounted in said cap and abutting a second housing rotary contact said second rotary contact and said second housing rotary contact defining a post and a concentric sleeve about said post;

a plug receptacle integral to the outer periphery of the housing and rotatable around the rotary cap, wherein the plug receptacle includes a first receptacle opening including a portion of the first housing rotary contact mounted therein; and a second receptacle opening including a portion of the second housing rotary contact mounted therein.

* * * * *